United States Patent [19]

Futakami

[11] Patent Number: 4,907,571

[45] Date of Patent: Mar. 13, 1990

[54] APPARATUS FOR THE PRACTICE OF AMBULATION

[75] Inventor: Kazuhiko Futakami, Shizuoka, Japan

[73] Assignee: Infutec Inc., Los Angeles, Calif.

[21] Appl. No.: 161,451

[22] Filed: Feb. 26, 1988

[30] Foreign Application Priority Data

| | | | |
|---|---|---|---|
| Aug. 21, 1987 | [JP] | Japan | 62-209026 |
| Aug. 28, 1987 | [JP] | Japan | 62-131105[U] |
| Nov. 13, 1987 | [JP] | Japan | 62-173265[U] |
| Feb. 17, 1988 | [JP] | Japan | 63-19810[U] |
| Feb. 19, 1988 | [JP] | Japan | 63-20800[U] |

[51] Int. Cl.[4] ..... A61H 1/02

[52] U.S. Cl. ..... 128/25 R; 272/70; 901/48

[58] Field of Search ..... 272/70, 70 A, 70.3, 272/70.4; 901/48, 9, 17, 18; 212/195; 414/921; 364/513; 128/25 R

[56] References Cited

U.S. PATENT DOCUMENTS

| | | | |
|---|---|---|---|
| 2,812,010 | 11/1957 | Abdallah | 272/70 A |
| 3,568,226 | 3/1971 | Mater et al. | 272/70.4 |
| 3,730,587 | 5/1973 | Bloxham et al. | 272/70.3 |
| 3,780,663 | 12/1973 | Pettit | 272/70 A |
| 3,985,082 | 10/1976 | Barac | 272/70 |
| 4,229,136 | 10/1980 | Panissidi | 901/48 |
| 4,256,098 | 3/1981 | Swan et al. | 272/70 |
| 4,421,450 | 12/1983 | Kouno | 901/48 |
| 4,549,732 | 10/1985 | Hoffman | 272/70 |

FOREIGN PATENT DOCUMENTS 63-96014 6/1988 Japan .

OTHER PUBLICATIONS

"The Development of Robot (AID-1) for a Practice of Ambulation", Takatoshi Ide et al., published Jun. 1, 1986, by Japan EM Co. Ltd.

*Primary Examiner*—Richard J. Apley
*Assistant Examiner*—J. Welsh
*Attorney, Agent, or Firm*—Lowe, Price, LeBlanc, Becker & Shur

[57] ABSTRACT

An apparatus for the practice of ambulation comprises a suspension member for suspending a patient, a weight sensor for detecting a weight applied to the suspension member, an air cylinder or motor for producing a predetermined suspension force to be conveyed to the suspension member, a horizontal arm for supporting the suspension member, and a rotation axle for rotating the horizontal arm and the suspension member so that the patient who is suspended by the suspension member can be trained in walking in accordance with a predetermined suspension force which is proportional to a weight detected by the weight sensor.

21 Claims, 25 Drawing Sheets

APPARATUS FOR THE PRACTICE OF AMBULATION

FIELD OF THE INVENTION

The invention relates to an apparatus for the practice of ambulation, and more particularly to an apparatus for the practice of ambulation by which a person who is hard to walk can be trained in improving the walking ability.

BACKGROUND OF THE INVENTION

In general, a person who finds it hard to walk (called "patient" hereinafter) is usually trained in a typical staged practice such as using a walking slope, parallel bars, walker means, and crutches in order with the aid of an occupational therapy staff or nurse.

In addition, such a walking practice as decreasing the weight burden in accordance with the buoyant force produced in a Hubbard tank or walking pool is also adopted with the aid of an occupational therapy staff or nurse.

In the conventional walking practices, however, there is a disadvantage that much aid by the other person and much time for the training are required for a patient. There is a further disadvantage that a patient can not enjoy the training sufficiently due to the limitation in number of occupational therapy staffs.

SUMMARY OF THE INVENTION

Accordingly, it is an object of the invention to provide an apparatus for the practice of ambulation in which a patient is trained in walking without any aid of other person.

It is another object of the invention to provide an apparatus for the practice of ambulation in which a patient is trained in improving the walking ability in a short time.

It is a further object of the invention to provide an apparatus for the practice of ambulation in which a patient can enjoy the training sufficiently by himself.

It is a still further object of the invention to provide an apparatus for the practice of ambulation in which there is occurred no danger even if a patient is trained by himself.

It is a yet still further object of the invention to provide an apparatus for the practice of ambulation in which training data or physical condition data are written into a memory and read therefrom.

According to the invention, an apparatus for the practice of ambulation comprises, means for suspending a patient in accordance with a predetermined suspension force, means for detecting a weight applied to said means for suspending, means for producing said predetermined suspension force proportional to said weight, means for supporting said means for suspending and conveying said predetermined suspension force, and means for rotating said means for supporting.

BRIEF DESCRIPTION OF THE DRAWINGS

The invention will be described in more detail in conjunction with drawings wherein.

DESCRIPTION OF PREFERRED EMBODIMENT

Figure 1:
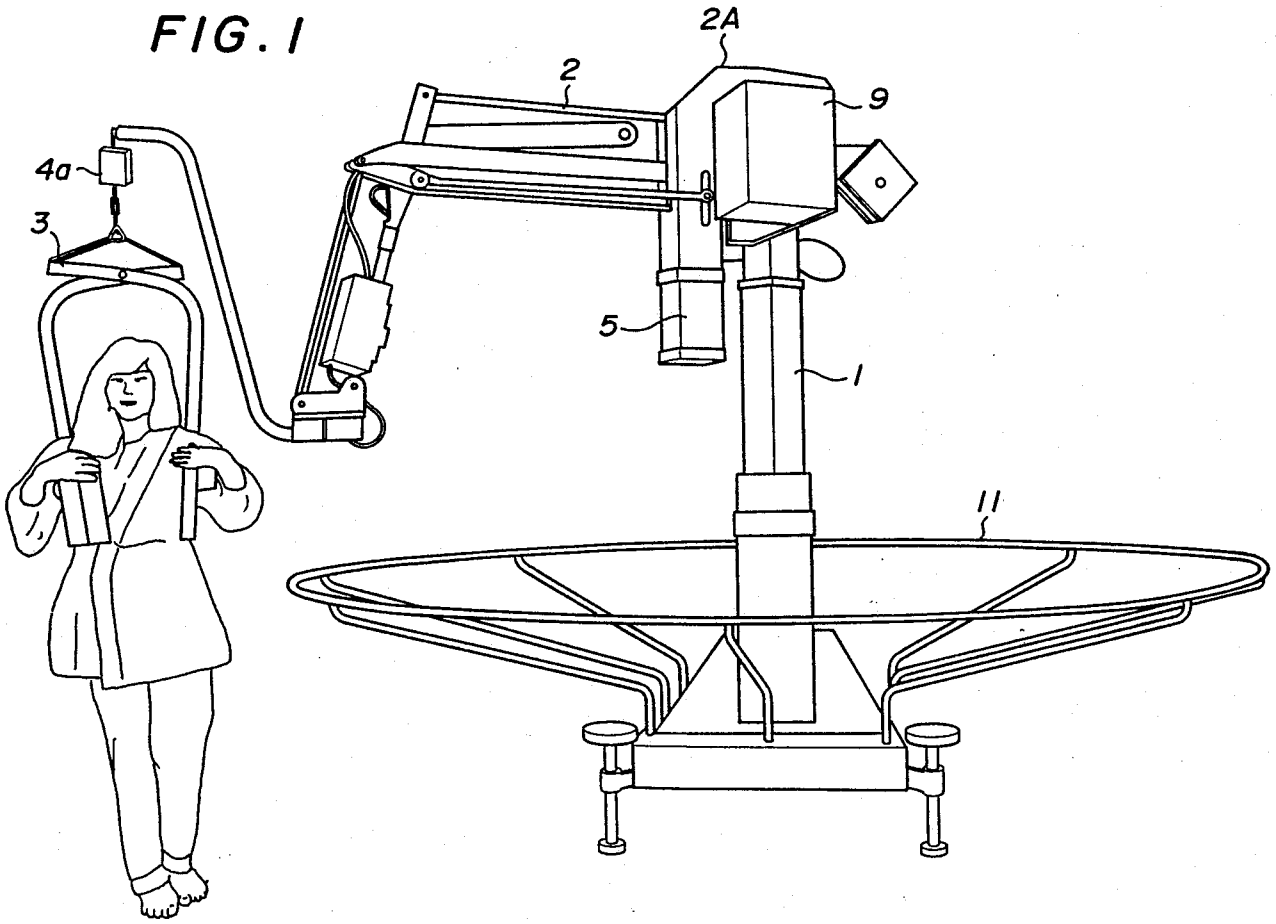
FIG. 1 is a perspective view showing an apparatus for the practice of ambulation in a first embodiment according to the invention.

In FIG. 1, there is shown an apparatus for the practice of ambulation which comprises a main body including a rotation axle (not shown) in the inside thereof, a supporting arm 2 rotating around the rotation axle of the main body 1 and moving in the upper and lower direction, for instance, by 30 degrees at one end thereof by means of a supporting means 2A, a suspension member 3 by which a patient is suspended, a weight sensor 4*a* for measuring a weight burden of the suspension member 3, a cylinder 5 for producing a predetermined suspension force, a control box 9 in which a control circuit is contained, and a handrail 11 along which the patient is trained in walking.

Figure 2A:
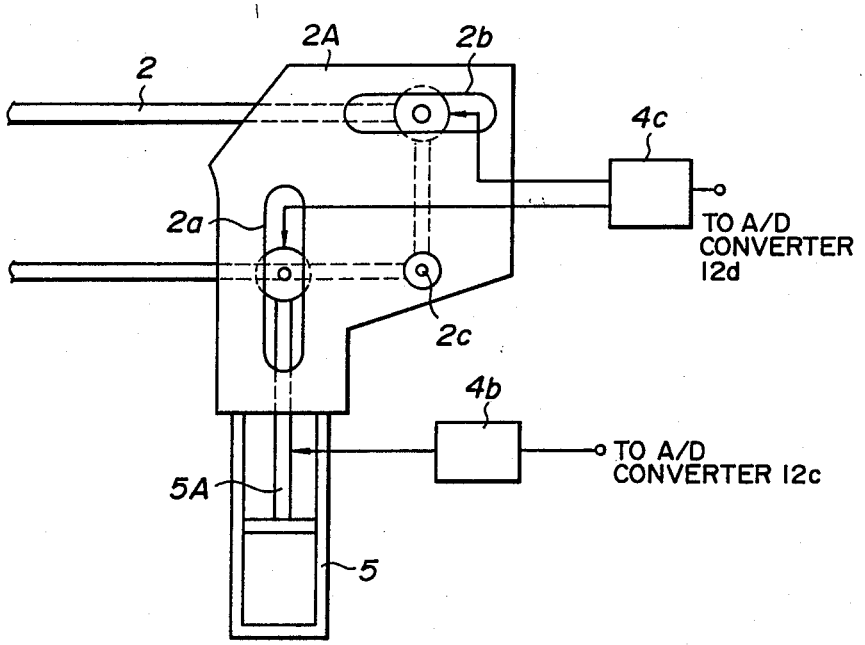
FIG. 2A is a plane view showing a supporting arm in the apparatus for the practice of ambulation in FIG. 1.

FIG. 2A shows the supporting means 2A for moving the supporting arm 2 in the upper and lower directions which includes two rod members sliding inside slots 2*a* and 2*b* respectively and having a common fulcrum 2C, the cylinder 5 having a piston rod 5A for producing a suspension force on one of the two rod members, an air pressure sensor 4*b* for detecting an air pressure therein, and a position level detector 4*c* for measuring a position level of the supporting arm 2 in accordance with positions of the two rod members in the slots 2*a* and 2*b*.

Figure 2B:
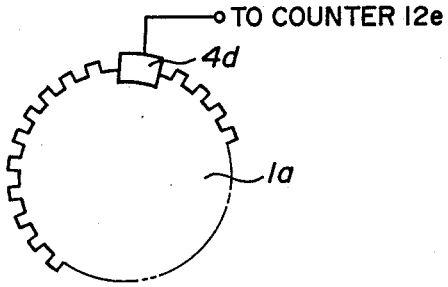
FIG. 2B is a pane view showing a photosensor for detecting the rotation number of a rotation axle in the apparatus for the practice of ambulation in FIG. 1.

FIG. 2B shows a rotation detector 4*d* for detecting the rotation of a rotation member 1*a* which is rotated by the rotation axle inside the main body 1.

Figure 3:
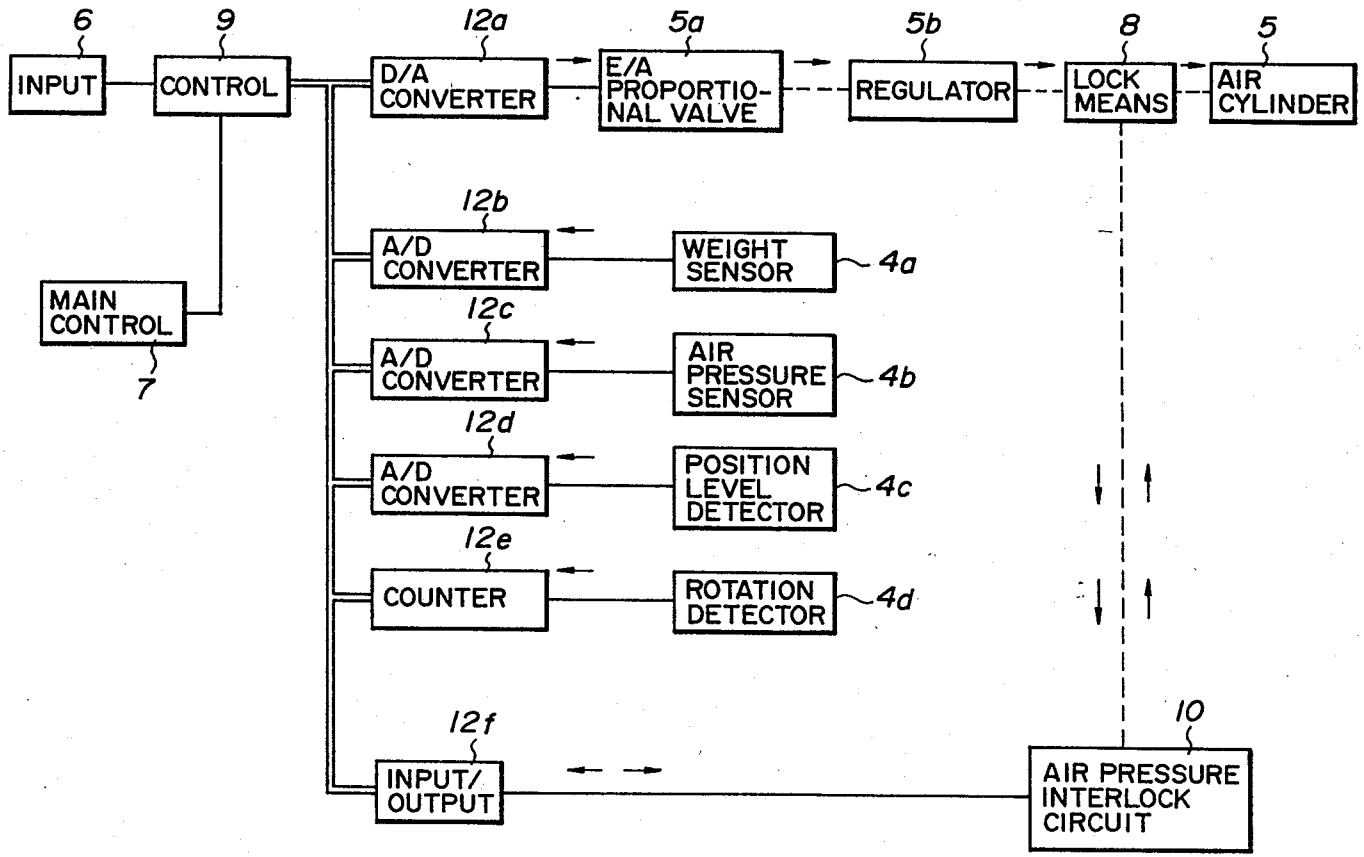
FIG. 3 is a block diagram showing a control system in the apparatus for the practice of ambulation in FIG. 1, FIGS. 4A to 4C are explanatory views showing comparators in the apparatus for the practice of ambulation in FIG. 1.

FIG. 3 shows a control circuit for controlling the apparatus for the practice of ambulation as shown in FIG. 1 to be operated wherein an unexpected danger is prevented for a patient from being occurred. The control circuit comprises the aforementioned weight sensor 4*a*, air pressure sensor 4*b*, position level detector 4*c* and rotation detector 4*d*, and electric air proportional valve 5*a* by which an aperture area of an air pressure circuit is controlled, an air regulator 5*b* for regulating an air pressure of the cylinder 5, an input unit 6 for inputting a predetermined suspension force which is instructed by a patient, a main control unit 7 for controlling whole system of the apparatus for the practice of ambulation, a lock means 8 for locking the adjustment of an air pressure of the cylinder 5, a control unit 9 for actuating the lock means 8, an air pressure interlock circuit 10 for detecting an abnormal state of the air pressure circuit and actuating the lock means 8, a digital-analog converter 12*a* for converting analog signals of the control unit 9 into digital signals to be supplied to the electric air proportional valve 5*a*, analog-digital converters 12*b* to 12*d* for converting analog signals of the weight sensor 4*a*, air pressure sensor 4*b* and position level detector 4*c* into digital signals respectively, a counter 12*e* for counting signals of a photosensor of the rotation detector 4*d*, and an input output unit 12*f* for supplying an abnormal signal to the air pressure interlock circuit 10 and inputting a status acknowledgement signal therefrom.

Figure 4C:
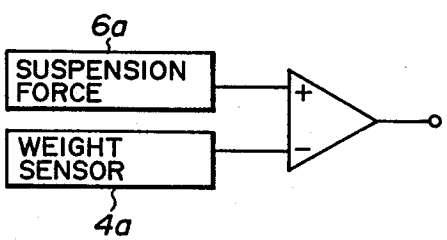
Figure 4B:
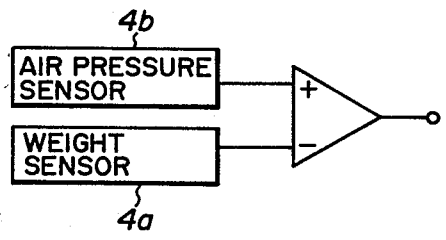
Figure 4A:
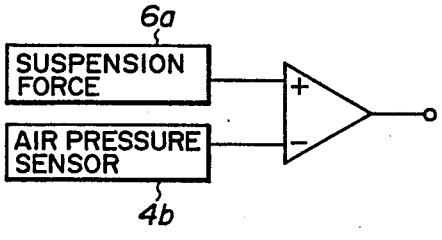

FIGS. 4A to 4C show a first to third comparators which are contained in the control unit 9. The first comparator compares a predetermined suspension force 6*a* which is instructed from the input unit 6 by a patient with a signal from the air pressure sensor 4*b*, the second comparator compares a signal from the air pressure sensor 4*b* with a signal from the weight sensor 4*a*, and the third comparator compares the predetermined suspension force 6*a* with a signal from the weight sensor 4*a*.

Figure 5:
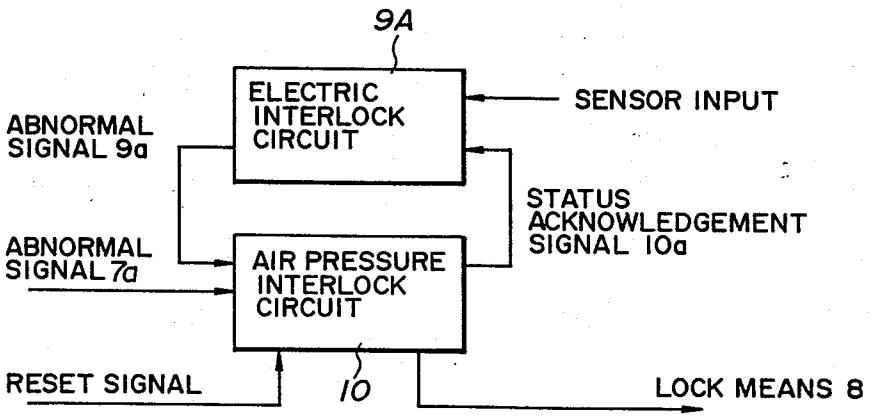
FIG. 5 is a block diagram showing interlock circuits in the apparatus for the practice of ambulation in FIG. 1, FIGS. 6A and 6B are block diagrams showing an apparatus for the practice of ambulation in a second and third embodiments according to the invention.

FIG. 5 shows a relation between an electric interlock circuit 9A which is included in the control unit 9 and the air pressure interlock circuit 10 wherein sensor signals are supplied from the sensors 4*a* to 4*c* and the rotation detector 4*d* to the electric interlock circuit 9A thereby to be interpreted therein together with the status acknowledgement signal indicating the status of the air pressure circuit supplied from the air pressure interlock circuit 10 so that an abnormal signal is supplied to the air interlock circuit 10 thereby to lock the lock means 8, while a reset signal and abnormal signal are supplied from the main control unit 7 to the air pressure interlock circuit 10 thereby to unlock and lock the lock means 8 respectively.

In operation, a ratio of a suspension force to a weight burden of the weight sensor 4*a* which is instructed by a patient is input through the input unit 6 to the control unit 9. In the control unit 9, the instructed suspension force is compared with the weight signal from the weight sensor 4*a* so that the aperture area of the electric air proportional valve 5*a* is controlled to regulate an air pressure of the cylinder 5 by means of the air regulator 5*b*. A suspension force determined in accordance with the instructed ratio and the weight burden of the weight sensor 4*a* is produced at the supporting arm 2 by means of the piston rod 5A of the cylinder 5 so that the patient is suspended by the suspension member 3 thereby to make it possible for the patient to practice the training of walking along the handrail 11. For instance, when an instructed ratio is 80% and a weight of a patient is 50 Kg, a suspension force of 40 Kg is produced. During the training of walking, signals are supplied from the air pressure sensor 4*b*, the position level detector 4*c*, and the rotation detector 4*d* to the control unit 9 in addition to a weight signal from the weight sensor 4*a*, so that the suspension force is varied dependent on the variation of the weight burden of the weight sensor 4*a* by means of the regulator 5*b*, a height of the patient is detected by the position level detector 4*c*, and a walking speed of the patient is detected by the rotation detector 4*d*. Here, if the patient falls down in the rear direction a weight burden applied to the weight sensor 4*a* is abruptly increased, the lowering of the patient is detected by the position level detector 4*c*, and the reverse rotation of the axle is detected by the rotation detector 4*d*. An abnormal signal is supplied through the input output unit 12*f* from the control unit 9 to the air pressure interlock circuit 10 whereby the lock means 8 is locked so that the air pressure circuit for the cylinder 5 is locked to maintain an air pressure dependent on a weight burden prior to the falling-down of the patient, and the rotation of the supporting arm 2 is fixed to be stopped in both directions. At the present stage, a shock is released against the patient by the air cylinder 5 which is locked in regard to an air pressure.

On the other hand, signals including a voltage supervisory signal, a watch-dog signal etc. are supplied from the main control unit 7 to the control unit 9 other than the aforementioned sensor signals. In the interlock circuits 9A and 10 as shown in FIG. 5, the signals of the electric interlock circuit 9A are supplied through the input output unit 12*f* to the air pressure interlock circuit 10 so that the lock means 8 is locked even in accordance with causes other than the falling-down of a patient.

Figure 6A:
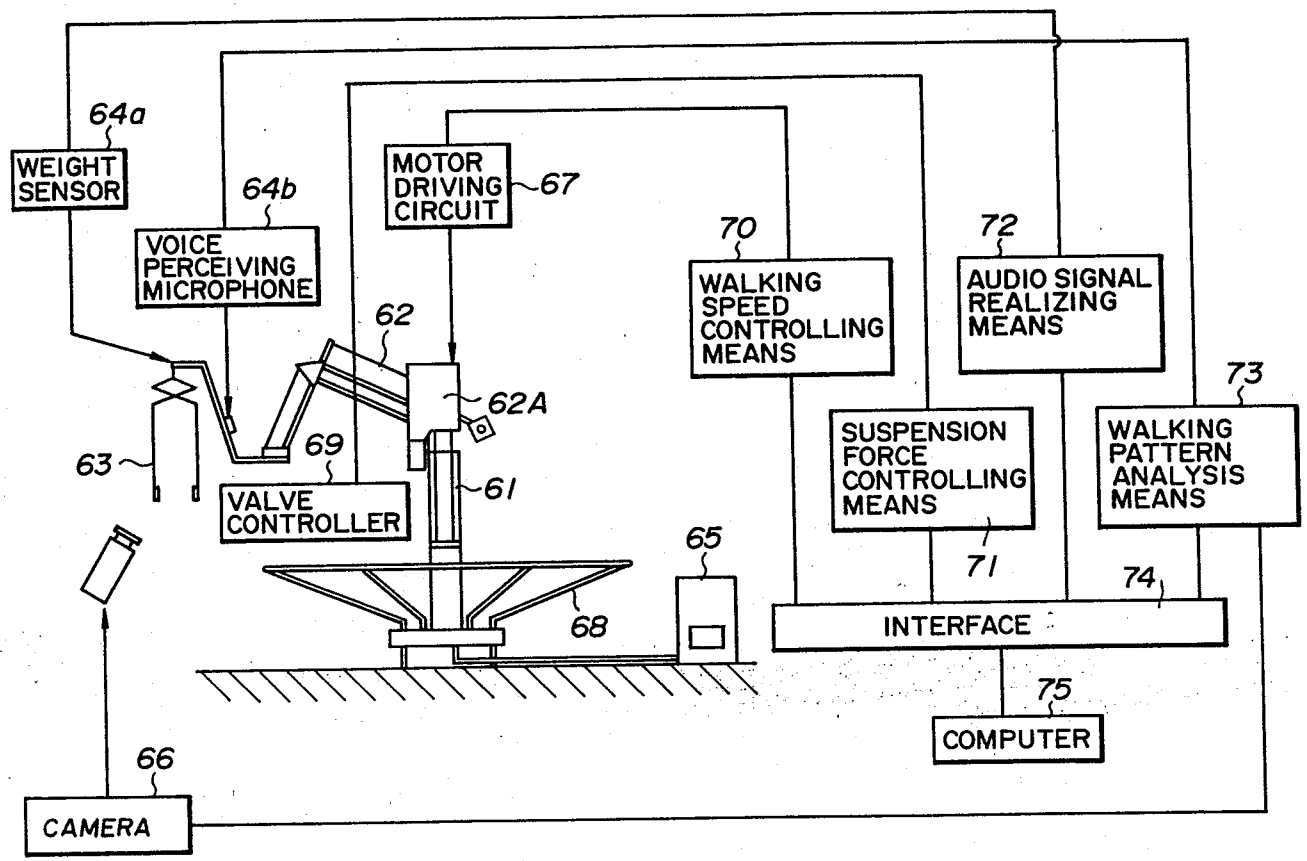

In FIG. 6A, there is shown an apparatus for the practice of ambulation in a second embodiment according to the invention. The apparatus for the practice of ambulation comprises a main body 61 including a rotation axle therein, a supporting arm 62 connected through a supporting means 62A to the main body 61, a suspension member 63 for suspending a patient, a weight sensor 64*a* for detecting a weight burden applied to the suspension member 63, a voice perceiving microphone 64*b* for receiving a voice of a patient, an air compressor 65 for feeding a compressed air, a video camera 66 for taking a picture of a walking pattern of a patient, a motor driving circuit 67 for driving a motor contained in the main body 61, a handrail 68 along which a patient walks, a valve controller 69 for controlling a valve of an air pressure circuit to be opened to a predetermined extent of an aperture area or to be closed, a walking speed controlling means 70 for controlling the motor to be driven by the motor driving circuit 67, a suspension force controlling means 71 for supplying a suspension force signal to the valve controller 69, an audio signal realizing means 72 for receiving an audio signal from the voice perceiving microphone 64*b*, a walking pattern analysis means 73 for receiving a video signal from the video camera 66, and a computer 75 connected through an interface 74 to the walking speed controlling means 70, suspension force controlling means 71, audio signal realizing means 72 and walking pattern analysis means 73.

In operation, a patient is suspended by the suspension member 63, and voice informations of the patient are supplied through the audio signal realizing means 72 from the voice perceiving microphone 64*b* to the computer 75. A suspension force of the suspension member 63 and walking speed of the patient are decided in accordance with the voice informations which are converted in the audio signal realizing means 72 into input signals supplied to the computer 75. The suspension force controlling means 71 supplies a suspension force signal to the valve controller 69 so that a suspension force instructed by the patient is produced at the suspension member 63 to suspend the patient, and the motor is driven through the motor driving circuit 67 by the walking speed controlling means 70 thereby to rotate the supporting arm 62 in a rotation speed instructed by the patient when the patient begins to walk in the suspension force and walking speed under the control of the computer 75, the video camera 66 supplies video signals relating to walking patterns of the patient to the walking pattern analysis means 73 in which walking patterns are analyzed whereby walking pattern signals are supplied to the computer 75. In a case where a walking speed is faster than a walking ability of the patient, the motor is decreased in its rotation speed to result in the decrease of the walking speed. In a case, further, where the video camera 66 finds the patient dangerous due to, for instance, the falling-down of the patient, the suspension force controlling means 72 controls the valve controller 69 to lock a lock means for a cylinder thereby to maintain a suspension force determined prior to the falling-down of the patient. On the other hand, when the training of walking is finished, the patient orders the computer 75 to cease the rotation of the supporting arm 62 by use of the voice perceiving microphone 64*b* so that the motor is stopped to rotate by the motor driving circuit 67 to which a stopping signal is supplied from the walking speed controlling means 70.

Figure 6B:
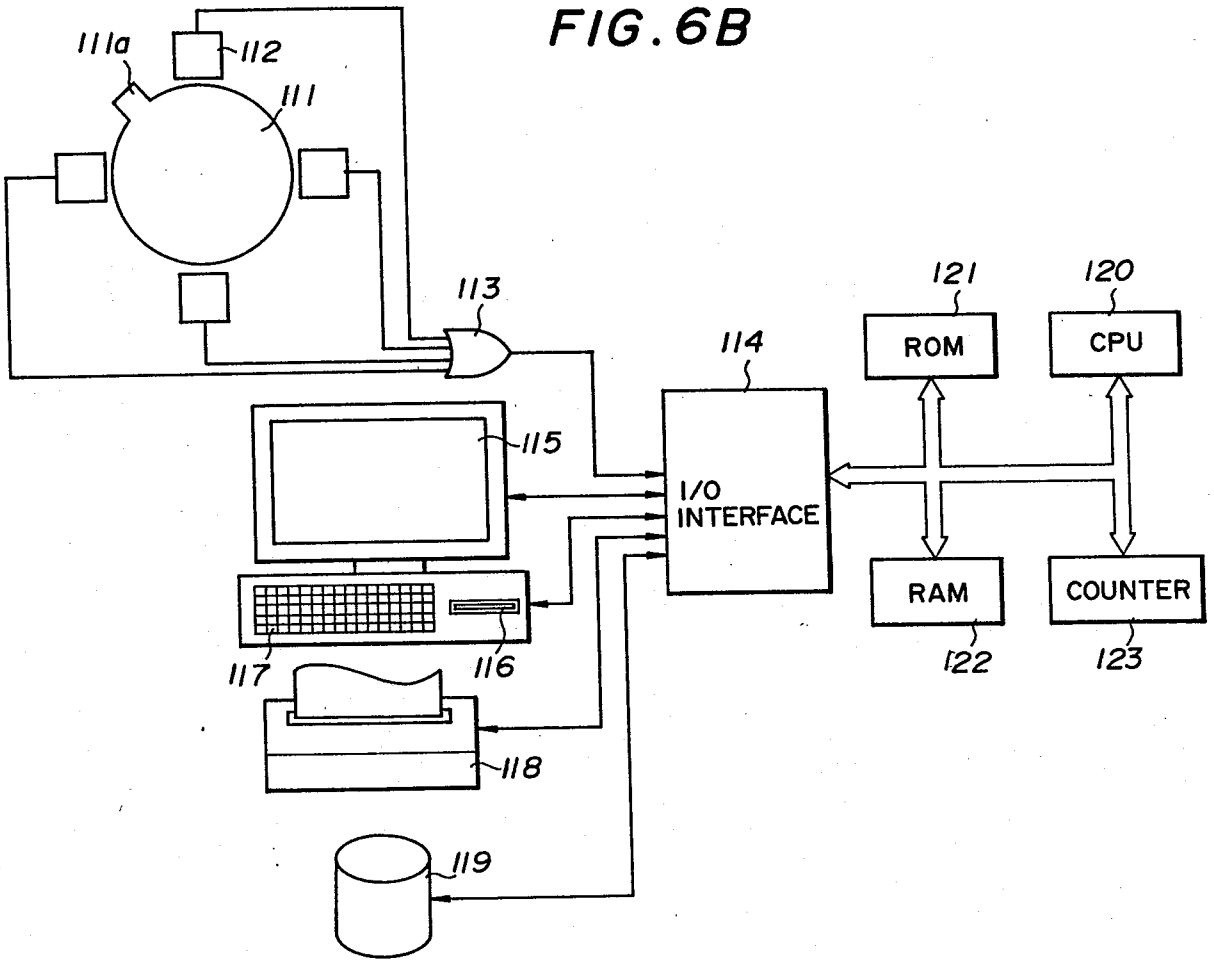

In FIG. 6B, there is shown an apparatus for the practice of ambulation in a third embodiment according to the invention. The apparatus for the practice of ambulation comprises a rotation member 111 having a protrusion 111*a* which is rotated by a rotation axle, a plurality of photosensors 112 for detecting the protrusion 11*a*, and OR circuit 113 through which signals from the photosensors 112 are passed, an input output interface 114 through which the signals of the OR circuit 113 are supplied to a control means including a CPU 120, a ROM 121, a RAM 122 and a counter circuit 12, a display 115 for displaying informations from the control means, a key board 117 having an IC memory card inserting slot 116 connected to the input output interface 114, and a printer 118 and an outer memory 119 also connected to the input output interface 114.

In operation, the rotation member 111 is rotated during the training of walking so that rotation signals are produced at the photosensors 112 each time when the protrusion 111*a* is detected by one of the photosensors 12. The rotation signals are counted by the counter circuit 12. If it is assumed that the number of the photosensors 122 is M, the counted value of the counter circuit 123 is N, and the distance of a circular walking path is $L_0$, a walking distance L of the patient is expressed in the equation (1).

$$L = L_0 \times \frac{N}{M} \tag{1}$$

If it is assumed that times which it takes the patient to walk the circular walking path are $T_1$, $T_2$, - - - Tn at respective times, the total walking time T is expressed in the equation (2).

$$T = T_1 + T_2 + \cdots + Tn \tag{2}$$

Therefore, the walking speed S of the patient is expressed in the equation (3).

$$S = L/T \tag{3}$$

Such walking data are stored into the RAM 122. On the other hand, an IC memory card carried individually by the patient is inserted into the IC memory card inserting slot 116 so that the aforementioned walking data are stored into the IC memory cared. Walking data are accumulated in the IC memory card at each time. Further, the walking data are displayed on the display 115. In such an occasion, target values for the patient may be displayed thereon together with values measured in the counter circuit 123 so that a comparison between both values can be made. The IC memory card may includes such instruction informations as a suspension force, walking speed, walking distance a day, and so on which are displayed on the display 115.

Figure 7:
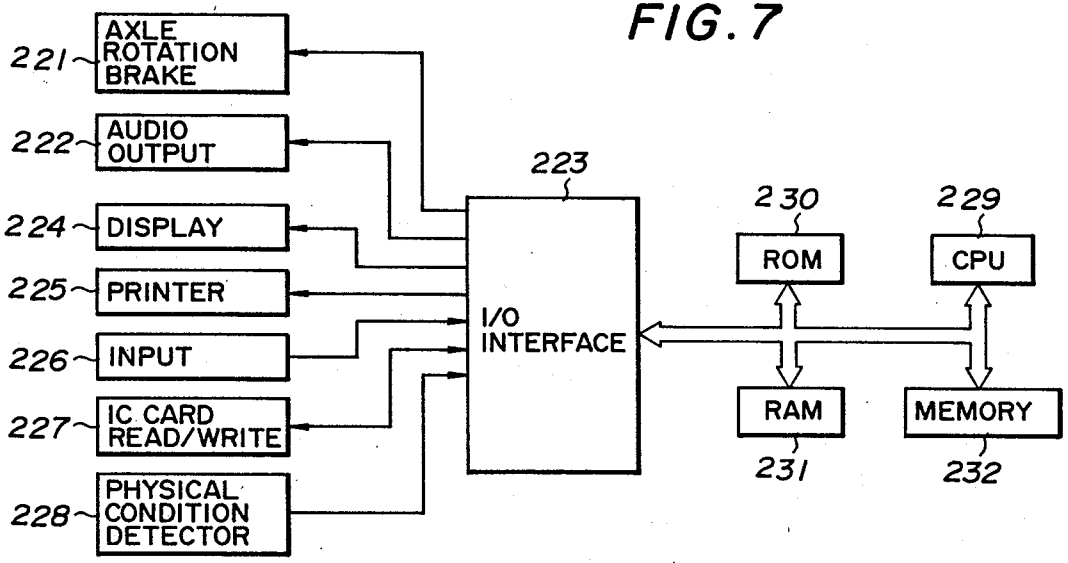
FIG. 7 is a block diagram showing an apparatus for the practice of ambulation in a fourth embodiment according to the invention.

In FIG. 7, there is shown an apparatus for the practice of ambulation in a fourth embodiment according to the invention. The apparatus for the practice of ambulation comprises a braking means 221 for braking a rotation axle, an audio signal output means 222 for producing a warning message etc., and input output interface 223 through which input and output signals passed, a display means 224 for displaying a physical condition of a patient etc., a printer 225 for printing physical condition data of the patient, an input means 226 for the input of data, instructions and so on, and IC memory card read-write means 227 for reading data from an IC memory card and writing data thereinto, a physical condition detector 228 for detecting the physical condition, and a computer 20 including a CPU 229, a ROM 230, a RAM 231, and a memory 232.

Figure 8:
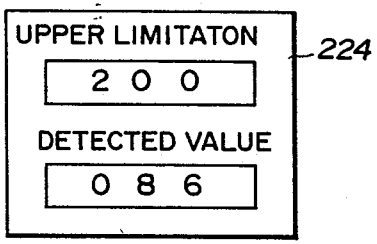
FIG. 8 is an explanatory view showing a display in the apparatus for the practice of ambulation in FIG. 7.

FIG. 8 shows an example of the display means 224 on which an upper limitation and presently detected value of a blood pressure of a patient are displayed.

Figure 9:
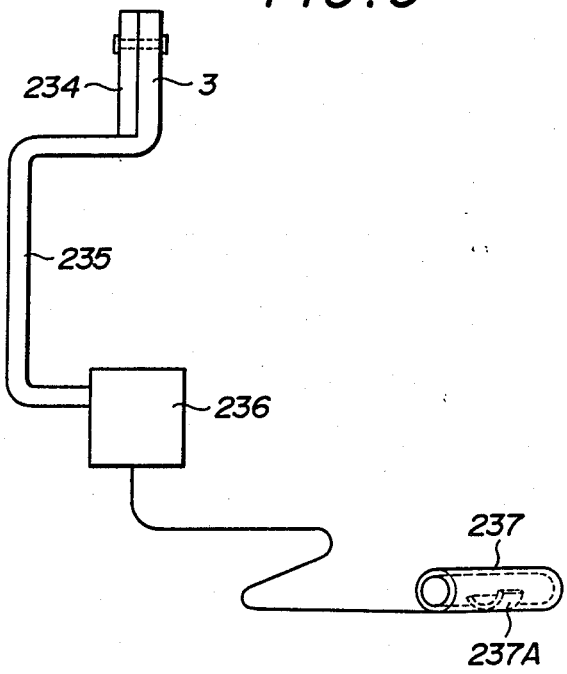
FIG. 9 is an explanatory view showing a blood pressure detecting means in the apparatus for the practice of ambulation in FIG. 7.

FIG. 9 shows a suspension member 3 comprising two frame rods 234 and 235, two armpit members 236 (one of which is shown) for supporting the armpits of a patient, a finger inserting member 237 in which a pressure sensitive element 237A is provided, and a signal cable 237B through which a blood pressure signal is transmitted from the pressure sensitive element 237A to the CPU 229 (FIG. 7).

Figure 10:
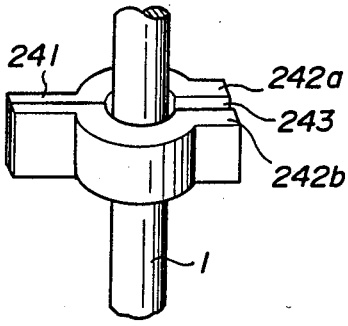
FIG. 10 is a perspective view showing a brake for a rotation axle in the apparatus for the practice of ambulation in FIG. 7.

FIG. 10 shows a braking means for a rotation axle 1 comprising braking members 242*a* and 242*b* having a gap 243 to be expanded by means of a spring (not shown), and a compressing means (not shown) for compressing the spring to brake the rotation axle.

In operation, a patient is suspended by the suspension members 3 wherein the armpit members 236 are applied under the armpits of the patient, and a selected finger, for instance, a forefinger is inserted into the finger inserting member 237. During the training of walking, a blood pressure is detected in the pressure sensitive element 273 which is in contact with the tip of the finger inserted into the finger inserting member 237 whereby blood pressure signals are supplied from the physical condition detector 228 to the CPU 229 in which a predetermined calculation is performed. In the calculation, a comparison between the upper limitation, for instance, "200 mmHg" as shown in FIG. 8 and a detected value, for instance, "86 mmHg" is made in regard to a blood pressure of the patient. The blood pressure upper limitation value is read from a personal IC memory card and written into the memory 232 to be compared with the detected value. The upper limitation value may be written into the memory 232 by means of the input means 226. In a case where a blood pressure of the patient is reached up to the upper limitation value, a warning signal is produced in the CPU 229 to actuate the braking means 221 to brake the rotation axle 1 simultaneously with the announcement of such warning messages as "please stop training" by means of the audio output means 222. Although a blood pressure is detected as a physical condition signal in the embodiment, pulsations etc. may be detected, for instance, by means of a sphygmomanometer. Such physical condition data may be stored through the IC memory card read-write means 227 in a personal IC memory card so that a patient can know the periodical change of his own physical condition.

Figure 11:
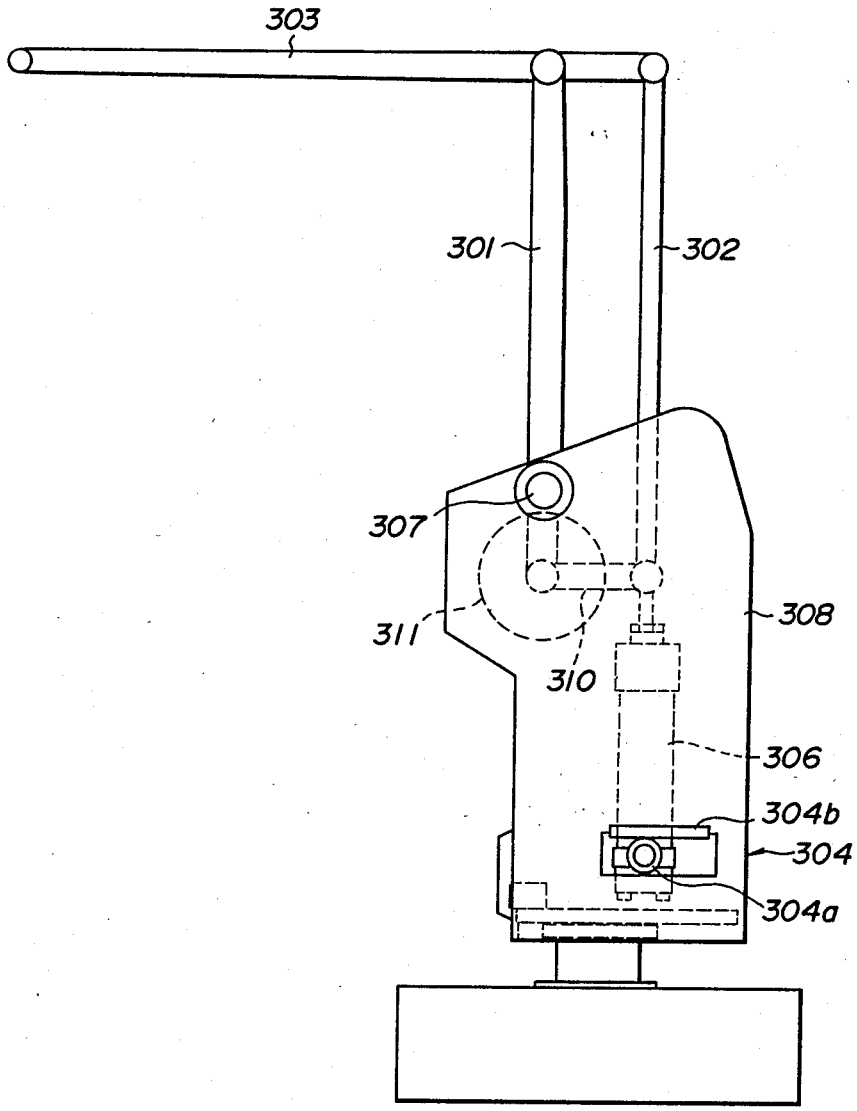
FIG. 11 is an explanatory view showing a supporting arm of an apparatus for the practice of ambulation in a fifth embodiment according to the invention.
Figure 12:
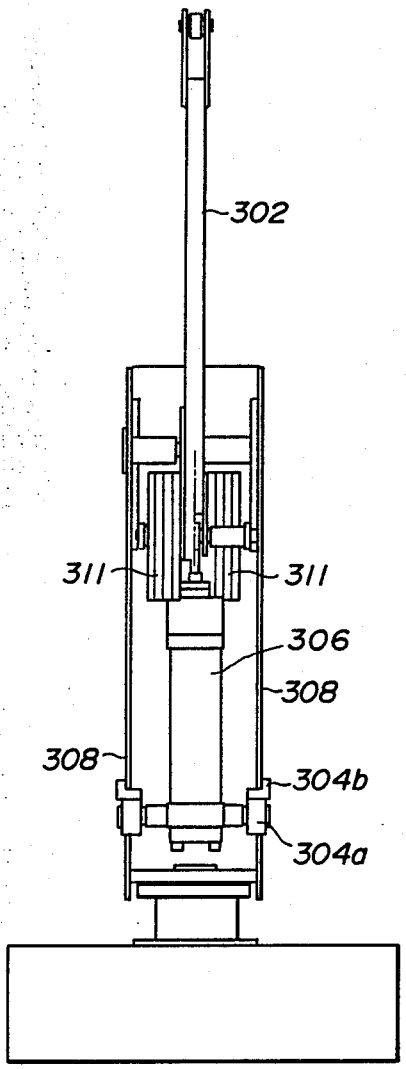
FIGS. 12 and 13 are side views showing the supporting arm of the apparatus for the practice of ambulation in FIG. 11, FIGS. 14 to 16 are explanatory views showing an operation of the supporting arm of the apparatus for the practice of ambulation in FIG. 11.

In FIGS. 11 and 12, there is shown an apparatus for the practice of ambulation in a fifth embodiment according to the invention. In the illustration of FIGS. 11 and 12, reference numeral 301 is a vertical arm fixed through a fulcrum 307 to side plates 308, reference numeral 302 is a parallel arm having the same length as the vertical arm 301, reference numeral 303 is a horizontal arm bearing a load at the tip portion thereof and to which the vertical and parallel arms 302 and 303 are pivoted, reference numeral 310 is a connecting arm for composing a pantograph means together with the vertical and parallel arms 302 and 303 pivoted thereto, and reference numeral 311 is counter weights provided at one end of the vertical arm 301 to be positioned between the side plates 308 so that the arms are balanced in its weight when no load is applied thereto. In addition, reference numeral 306 is a cylinder for producing a suspension force, and reference numeral 304 is a horizontal moving means which comprises a roller 304*a* provided on the lower portion of the cylinder 306, and a rail 304*b* on which the roller 304*a* runs.

Figure 13:
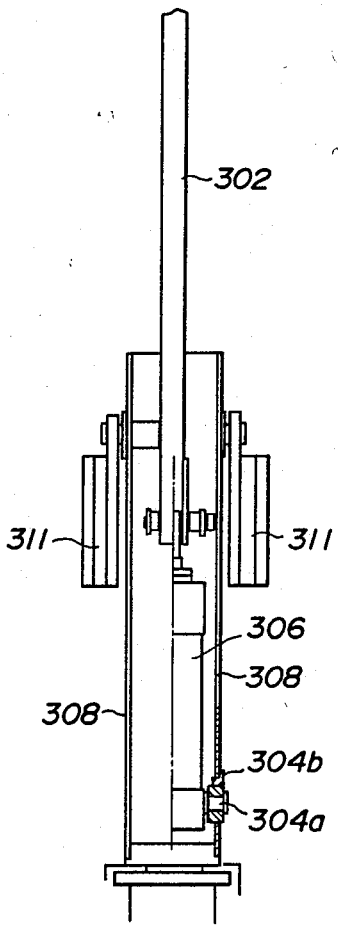

FIG. 13 shows a modification of the apparatus for the practice of ambulation in FIGS. 11 and 12 wherein like parts are indicated by like reference numerals and there is a difference that the counter weights 11 are provided on the outside of the side plates 308.

Figure 14:
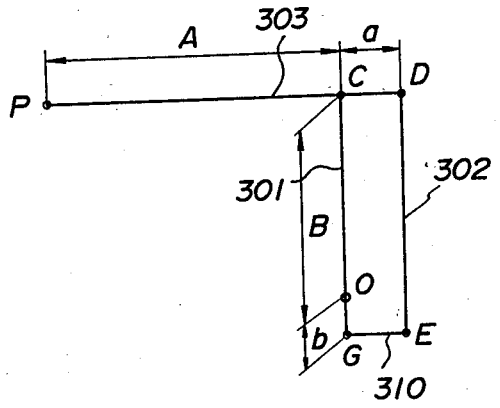

In operation, a ratio of the arms is defined in a following equation.

$$i = A/a = B/b$$

where i is the ratio, and A, B, c and d are lengths of the arms 301 and 303 as illustrated in FIG. 14 wherein like parts are indicated by like reference numerals in FIGS. 11 and 12, reference symbols P and O are the tip portion of the horizontal arm 303 and the fulcrum of the vertical arm 301, and reference symbols C, D, G and E are pivoted points of the vertical and parallel arms 301 and 302 in regard to the horizontal and connecting arms 303 and 310. As understood in the illustration, a triangle PCO is a similar figure of a triangle EGO.

Figure 15:
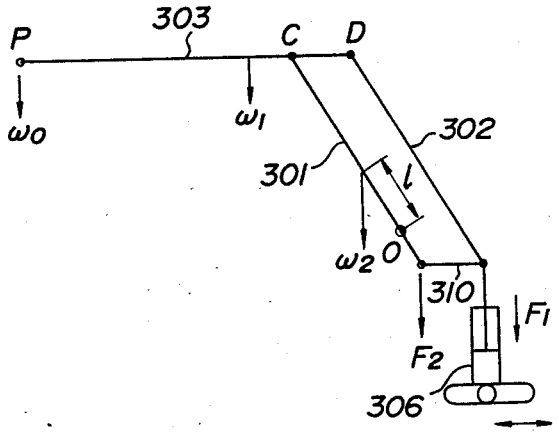

In FIG. 15, if it is assumed that a load is $W_0$, and the weights of the arms 303 and 301 is $W_1$ and $W_2$, a force $F_1$ which is produced at the point E by the cylinder 306 is defined in a following equation so that the load $W_0$ is balanced in regard to the force $F_1$.

$$F_1 = W_0 \times i$$

On the other hand, a force $F_2$ which is produced at the point G by the counter weights 311 is defined in a following equation so that the arms 303 and 301 are balanced in regard to the weights $W_1$ and $W_2$ when no load is applied to the point P of the horizontal arm 303.

$$F_2 = W_1 \times i + W_2 \times \frac{1}{b}$$

where l is a distance of the weight center of the arm 301.

Figure 16:
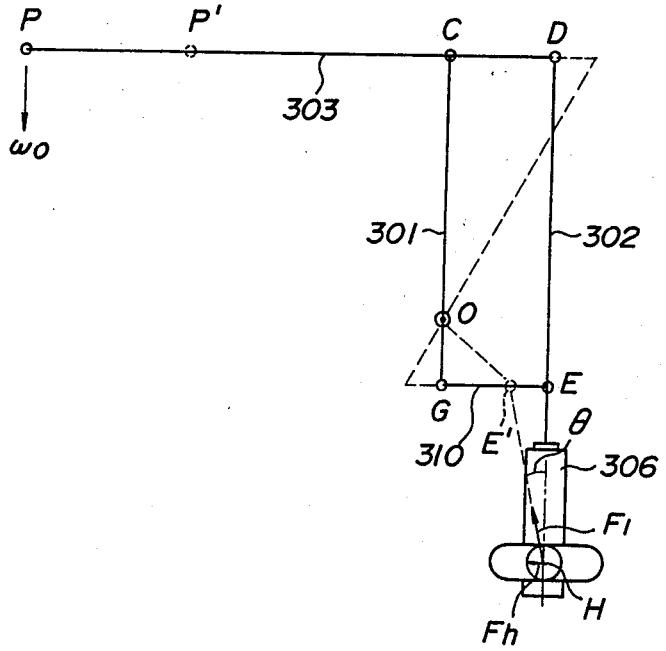

In FIG. 16, if it is assumed that the tip portion of the horizontal arm 303 bearing the load $W_0$ is moved from the point P to the point P', the point E at which the parallel arm 302 and the piston rod of the cylinder 306 are connected is moved in the horizontal direction from the point E to the point E' so that the vertical arm 301 is inclined on the fulcrum 0. At this moment, the aforementioned force $F_1$ acts on a line E to H thereby to make the length minimum, where the point H is the center of the roller 304*a*. As a result, when the point E is moved to the point E', a horizontal component $F_h$ of the force $F_1$ is defined in a following equation.

$$F_h = F_1 \times \sin\theta$$

where $\theta$ is an angle EHE'.

As understood from the equation, the larger the angle $\theta$ is, the greater the horizontal component $F_h$ becomes. For this reason, the point H is smoothly moved in the horizontal direction as the cylinder 306 is inclined by use of the horizontal moving means 304.

In other words, the imbalance of a load $W_0'$ is reversely proportional to the angle $\theta$ as follows.

$$W_0' = F_1 \times \cos\theta / i$$

Accordingly, the roller 306 is moved in accordance with an increasing horizontal component $F_h$ so that the balance of a load is easily obtained.

Figure 17:
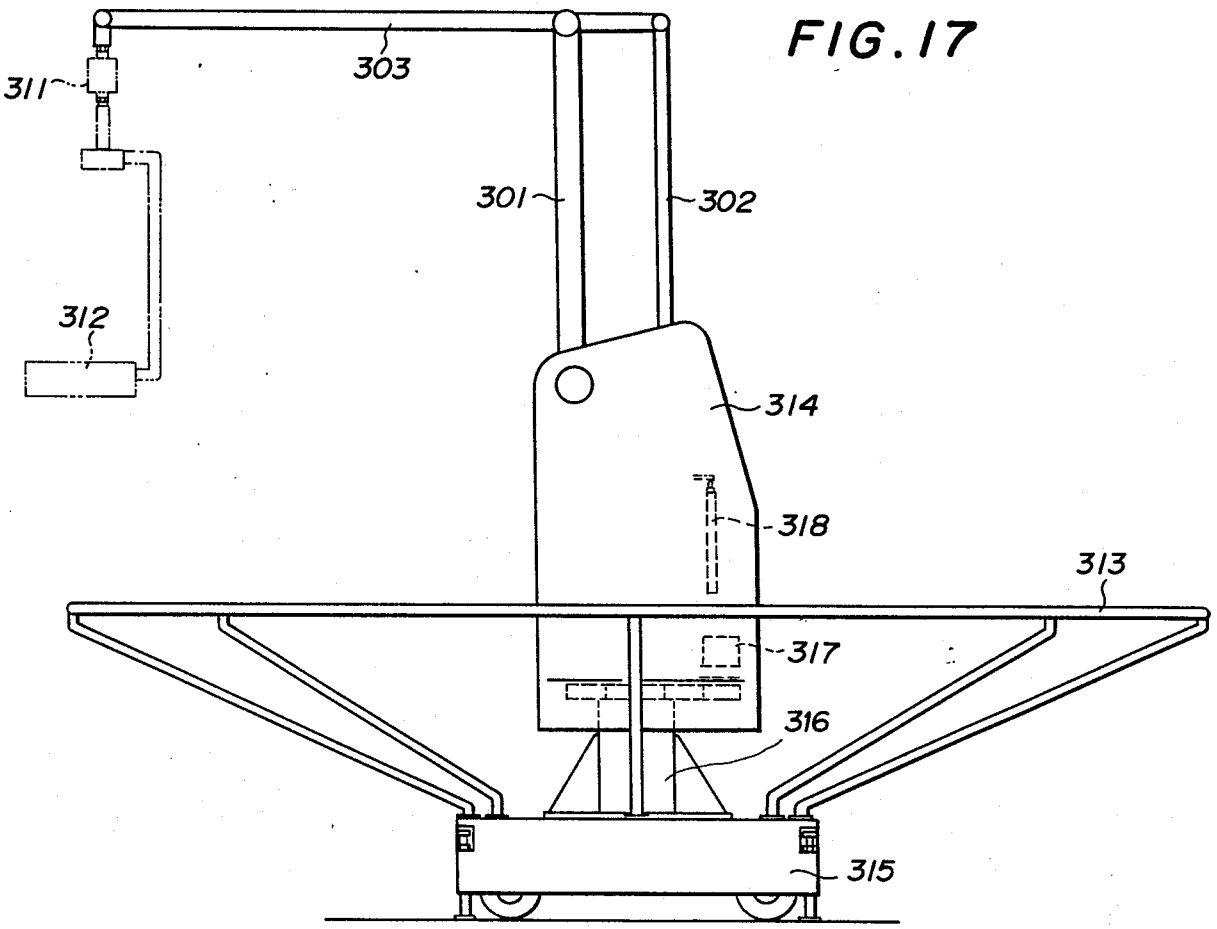
FIG. 17 is an explanatory view showing the apparatus for the practice of ambulation in FIG. 11, FIGS. 18A to 18C are explanatory views showing an apparatus for the practice of ambulation in a sixth embodiment according to the invention.

FIG. 17 shows an apparatus for the practice of ambulation in which a pantograph means is utilized as described in FIGS. 11 to 16. The apparatus for the practice of ambulation is composed such that a suspension member 312 is provided through a weight sensor 311 at the tip portion of a horizontal arm 303, and a vertical and parallel arms 301 and 302 are pivoted at two points of the horizontal arm 303 and supported by a main body 314 which is rotated around an axle 316 provided on a base member 315. In the main body 314, a potentiometer 318 is provided for detecting a height of the suspension member 312 together with a braking means for braking the horizontal arm 303 to be stopped, for instance, at the time of an emergency, and a handrail 31 is provided on the base member 315 for helping a patient walk therearound.

Figure 18A:
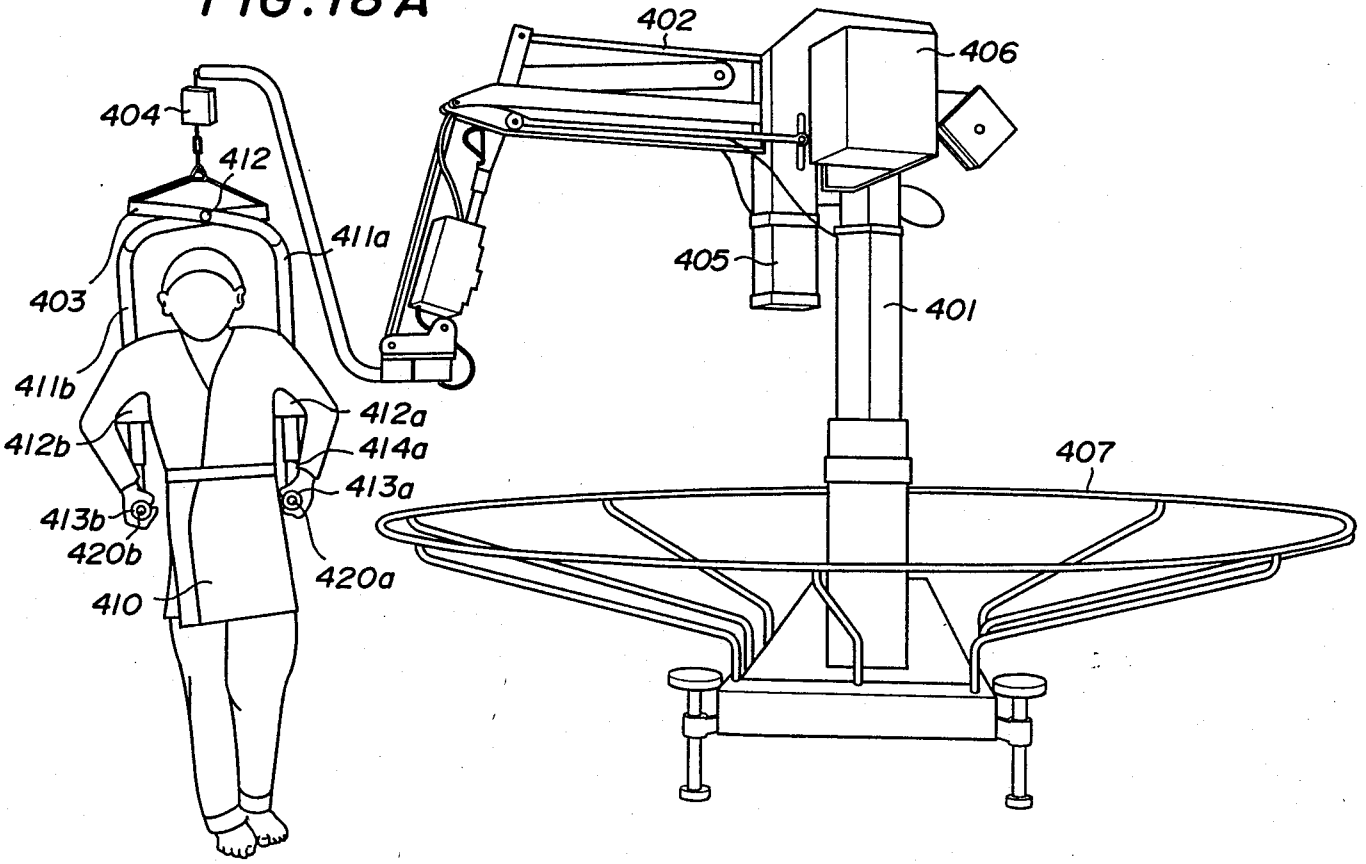
Figure 18B:
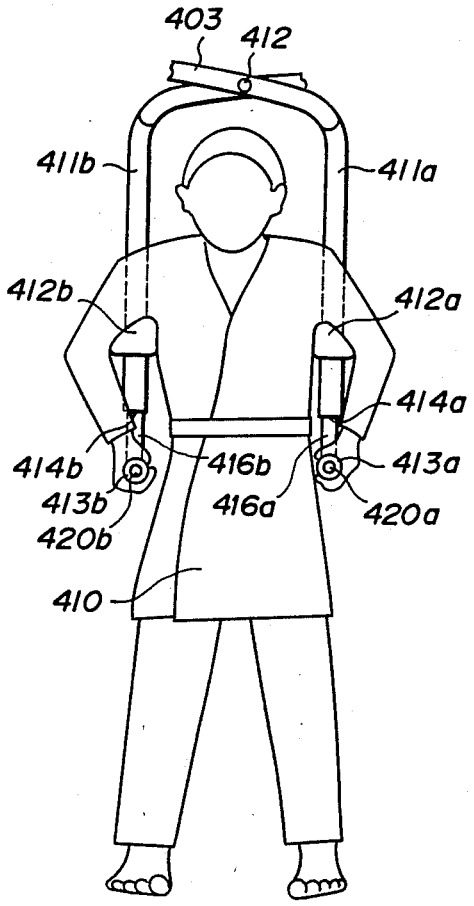
Figure 18C:
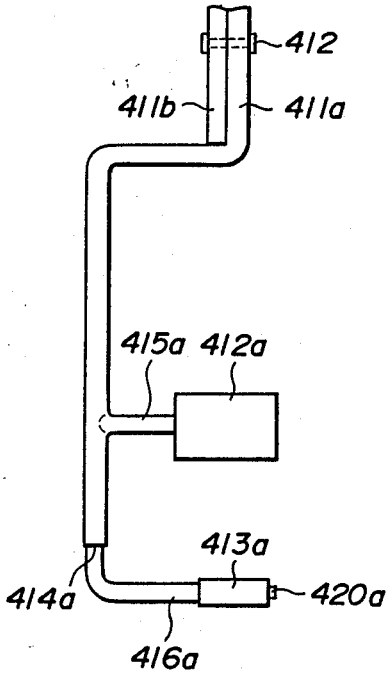

In FIGS. 18A to 18C, there is shown an apparatus for the practice of ambulation in a sixth embodiment according to the invention. The apparatus for the practice of ambulation comprises a main body 401, a supporting arm 402, a suspension member 403, a weight sensor 404, a cylinder 405, a control box 406, and a handrail 407. The suspension member 403 comprises a pair of frame members 411*a* and 411*b* each provided with a right angle frame member 415*a*, a pair of armpit supporting members 412*a* and 412*b* each provided on the right angle frame member 415*a*, and a pair of frame members 416*a* each connected through an expanding and shrinking portion 414*a* to the frame member 411*a* and provided at the end portion with grip portion 413*a* (413*b*) wherein the frame members 411*a* and 411*b* are hinged at a connecting point 412, and a pair of pressure control buttons 420*a* and 420*b* are provided on the corresponding grip portions 413*a* and 413*b*.

Figure 19:
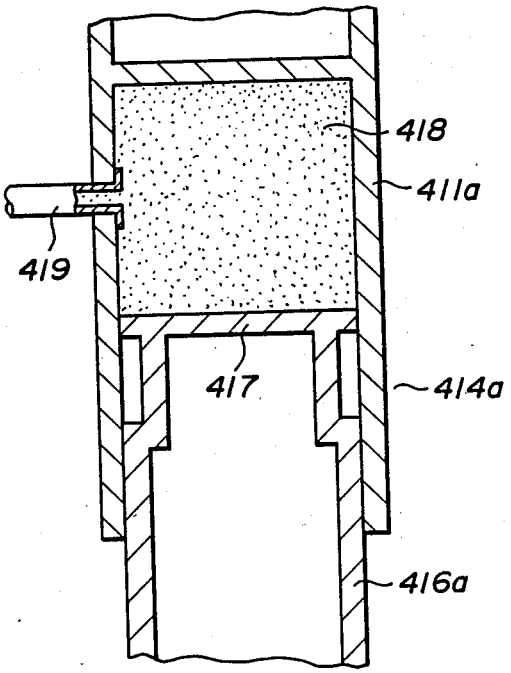
FIG. 19 is a cross sectional view showing a cylinder in the apparatus for the practice of ambulation in FIG. 18A, FIGS. 20A to 20C are perspective views showing unit members for a handrail in the apparatus of the practice of ambulation in FIG. 1, FIGS. 21 and 22 are explanatory views showing handrails in the apparatus for the practice of ambulation in FIG. 1, FIGS. 23 and 24 are explanatory views showing circular walking paths in the apparatus for the practice of ambulation in FIG. 1, FIGS. 25A and 25B are perspective views showing a stairway and slope positioned on a walking path of the apparatus for the practice of ambulation in FIG. 1.

FIG. 19 shows an air cylinder means 418 provided in each of the frame members 411*a* and 411*b*. The air cylinder means 418 is provided with a pressure pipe 419 through which a predetermined pressure of air is supplied thereto. The supply of air is controlled by the respective pressure control buttons 410*a* and 420*b* which are pushed on and off by a patient 410.

In operation, the patient 410 is suspended by the suspension member 401 wherein the armpit members 412*a* and 412*b* are positioned under the armpits of the patient 410, and the grip portions 413*a* and 413*b* are gripped by the patient 410 so that the patient 410 is supported not only by the armpit members 412*a* and 412*b*, but also by the arms and hands gripping the grip portions 413*a* and 413*b*. Therefore, the patient 410 can be avoided to have a skin sore under the armpits. In addition, when the patient 410 pushes the pressure control buttons 420*a* and 420*b* on and off, an air pressure of the air cylinder means 418 is controlled so that the frames members 416*b* (416*b*) are moved as piston rods at the expanding and shrinking portions 414*a* and 414*b*. Accordingly, the grip portions 413*a* and 413*b* can be adjusted to take appropriate positions for a patient respectively in regard to lengths from the armpit members 412*a* and 412*b*.

Figure 20A:
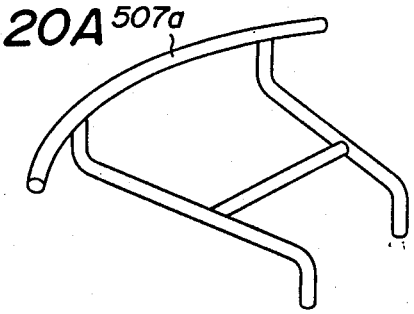
Figure 20B:
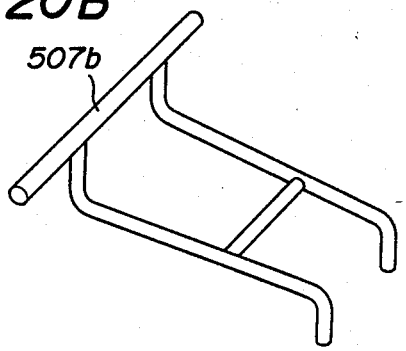
Figure 20C:
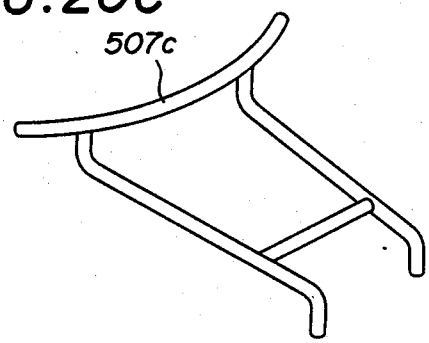

FIGS. 20A to 20C show unit members 507*a*, 507*b* and 507*c* for a handrail, for instance, in the apparatus for the practice of ambulation. The unit member 507*a* is of a forward circular arc, the unit member 507*b* is of a straight line, and the unit member 507*c* is of a reverse circular arc.

Figure 21:
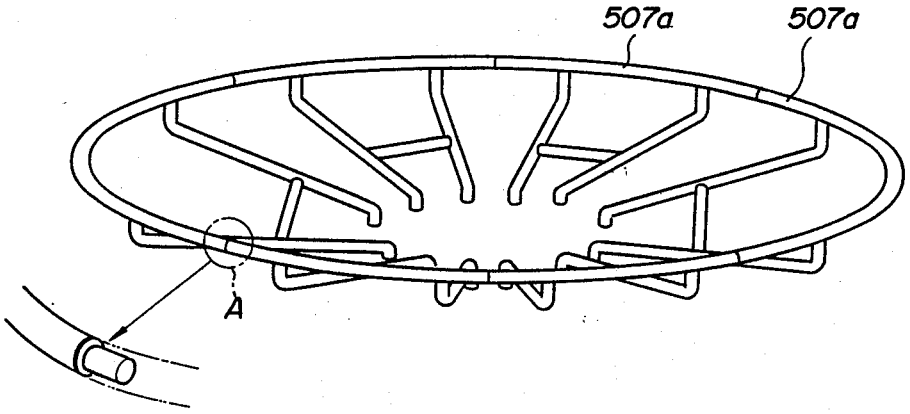

FIG. 21 shows a circular handrail which is composed of a predetermined number of the unit members 507*a*. The unit members 507*a* are connected at portions A as illustrated.

Figure 22:
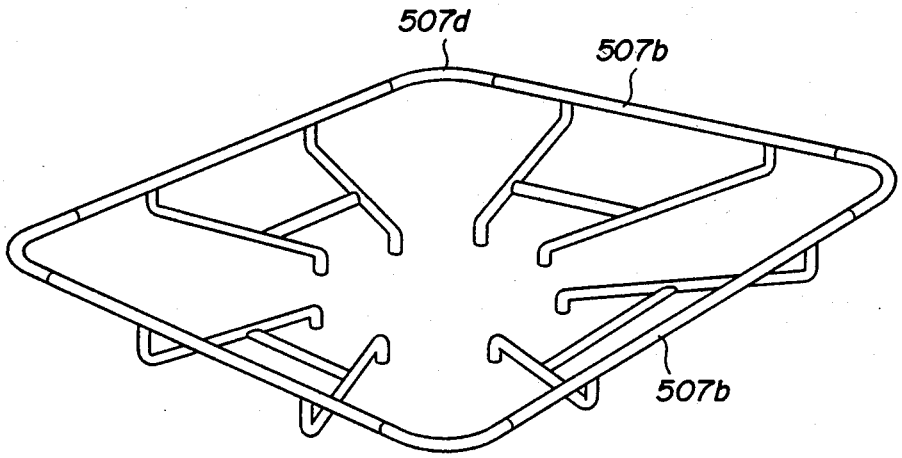

FIG. 22 shows a rectangle handrail which is composed of a predetermined number of the unit members 507*b* and four corner members 507*d*.

Figure 23:
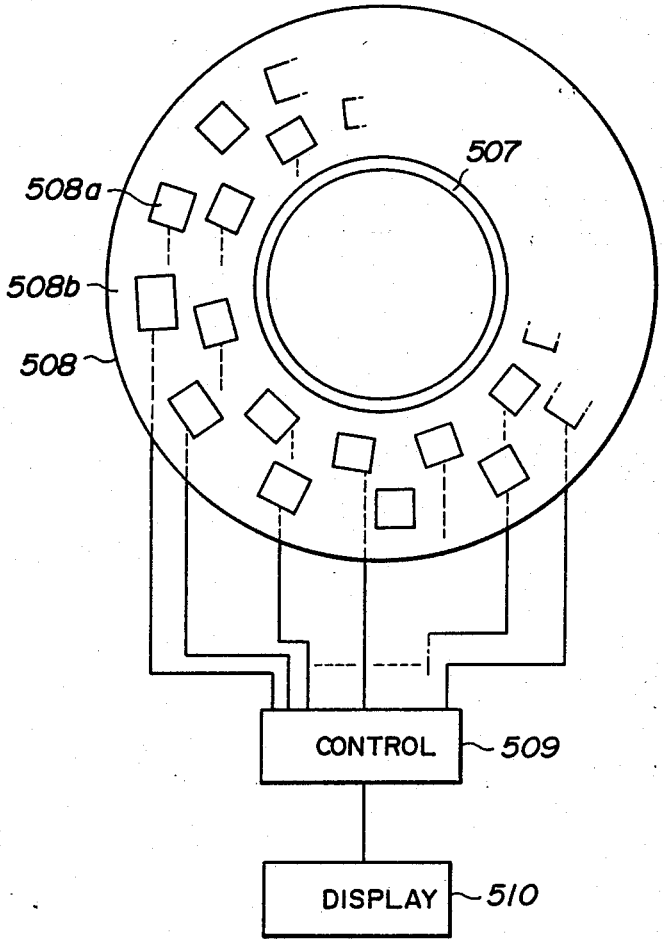

FIG. 23 shows a carpet 508 arranged around a handrail 507. The carpet 508 includes a predetermined number of first pressure sensitive regions 8*a* and a second pressure sensitive region 8*b* respectively connected to a control unit 509. The control unit 509 includes a ROM for storing programs for games and a CPU for calculating scores of the games, and is connected to a display means 510 for displaying the scores.

In operation, a patient who is suspended by a suspension member walks on the carpet 508 wherein when the patient steps exactly on one of the first pressure sensitive regions 508*a*, the score is kept in the control unit 509. On the other hand, the score is lost in the control unit 509, if the patient steps off the first pressure sensitive regions 508*a* so that the second pressure sensitive region 508*b* supplies a signal to the control unit 509. As a result, the score of the patient is displayed on the display means 510 so that the patient can enjoy the training of walking. Such scores may be stored in a personal IC memory card as mentioned before.

Figure 24:
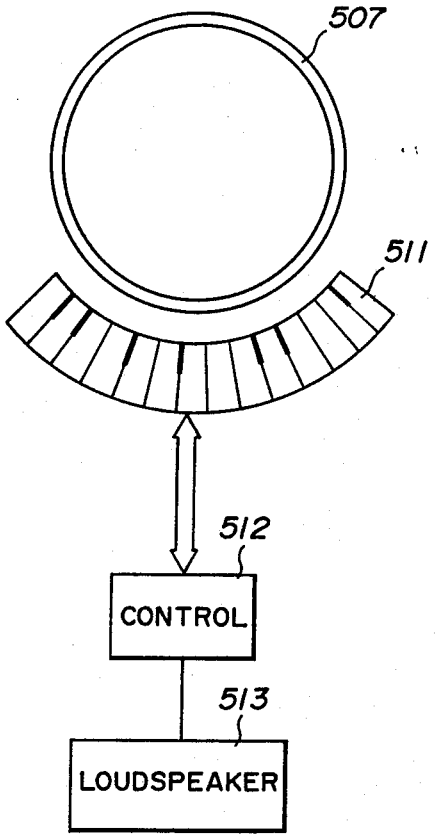

FIG. 24 shows a keyboard-shaped pressure sensitive members 511 arranged around a handrail 507. The pressure sensitive members 511 are connected through a signal cable to a control unit 512. The control unit 512 comprises an audio signal synthesizing means for producing audio signals in accordance with signals supplied from the pressure sensitive members 511, and is connected to a loudspeaker 513.

In operation, a patient who is suspended by a suspension member walks along the handrail 507. On the pressure sensitive members 511, the patient steps on selected members among the pressure sensitive members 511 so that signals corresponding to the selected pressure sensitive members 511 are supplied to the control unit 512 in which the signals are stored in a memory. The audio signal synthesizing means of the control unit 512 produces audio signals dependent on the signals of the memory so that a music composed by the patient is broadcast from the loudspeaker 513.

Figure 25A:
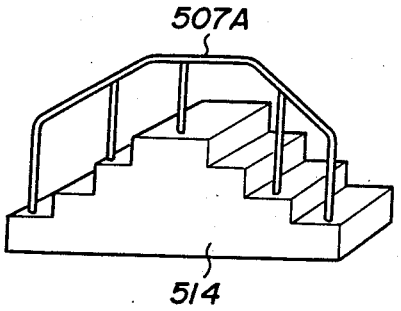
Figure 25B:
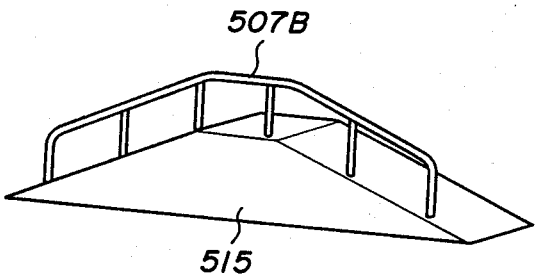

FIGS. 25A and 25B show such optional training instruments as a stairway 512 and a slope 515. The stairway 514 and the slope 515 are provided with handrails 507A and 507B respectively. A patient may choose any of the stairway 512, the slope 515 and so on dependent on the training degree, walking ability and so on.

Figure 26:
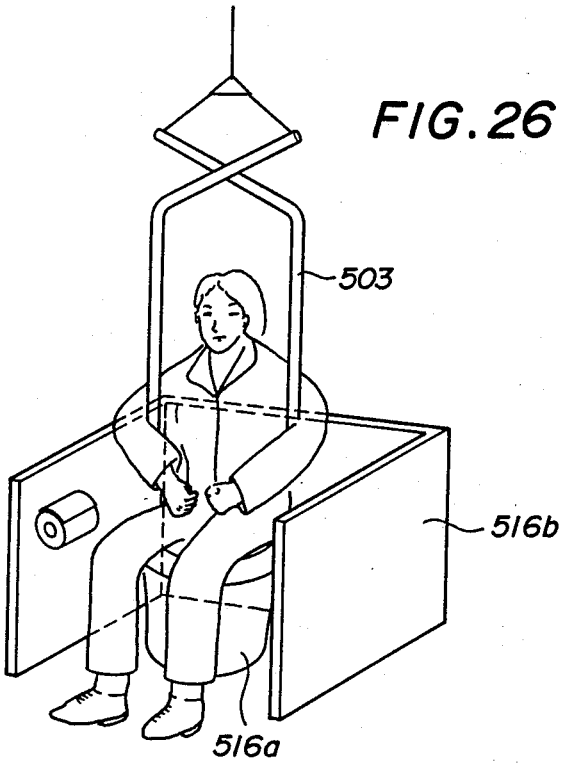
FIG. 26 is a perspective view showing a toilet provided on a walking path of the apparatus for the practice of ambulation in FIG. 1, FIGS. 27A and 27B are perspective views showing a patient to be carried by a wheelchair who is trained in an apparatus for the practice of ambulation in a seventh embodiment according to the invention.

FIG. 26 shows an apparatus for the practice of ambulation which is applied to means for helping a patient go to a lavatory in which a toilet stool 516*a* and wall member 516*b* are provided. The apparatus for the practice of ambulation is installed between a bed for the patient and the provisional lavatory so that the patient who is suspended by the suspension member 503 can go there and back to the bed by himself.

Figure 27A:
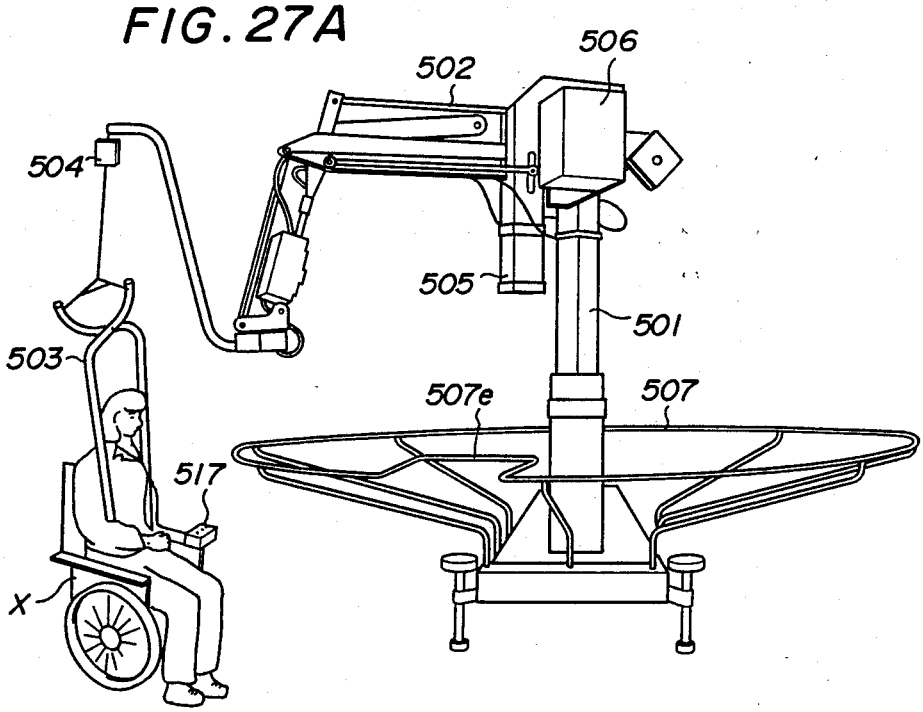
Figure 27B:
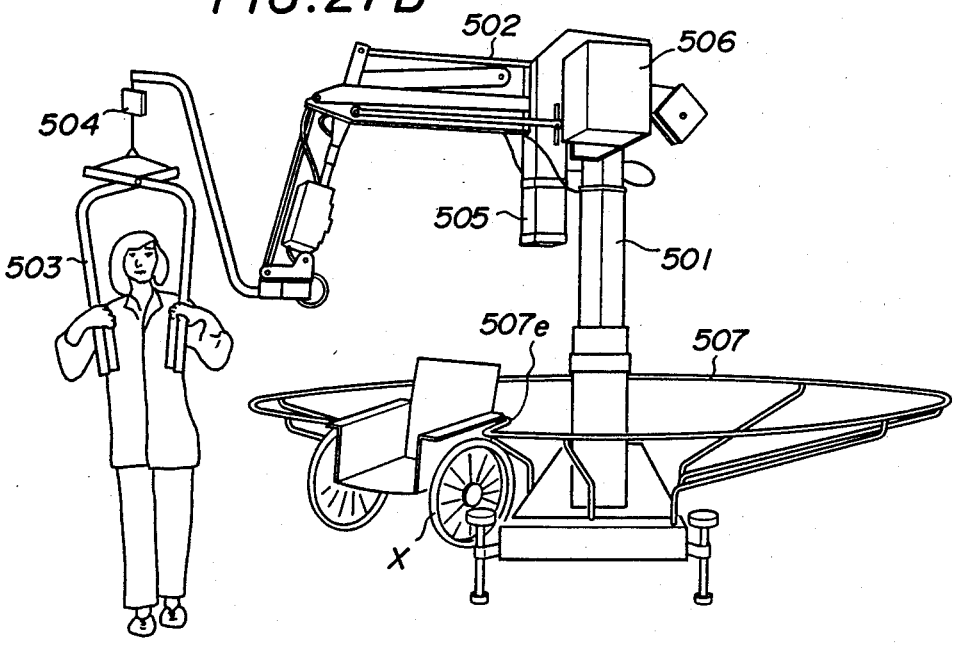

FIGS. 27A and 27B show an apparatus for the practice of ambulation which comprises a main body 501, a supporting arm 502, a suspension member 503, a weight sensor 504, a cylinder 505, a control box 506, and a handrail 507 having a recess portion 507*e* for a wheelchair X.

In operation, a patient who is carried on the wheelchair X can come to the walking path around the handrail 507 by himself so that the patient can be trained in walking around the handrail 507 under the condition that the wheelchair X is positioned inside the recess portion 507*e* thereof.

Figure 28:
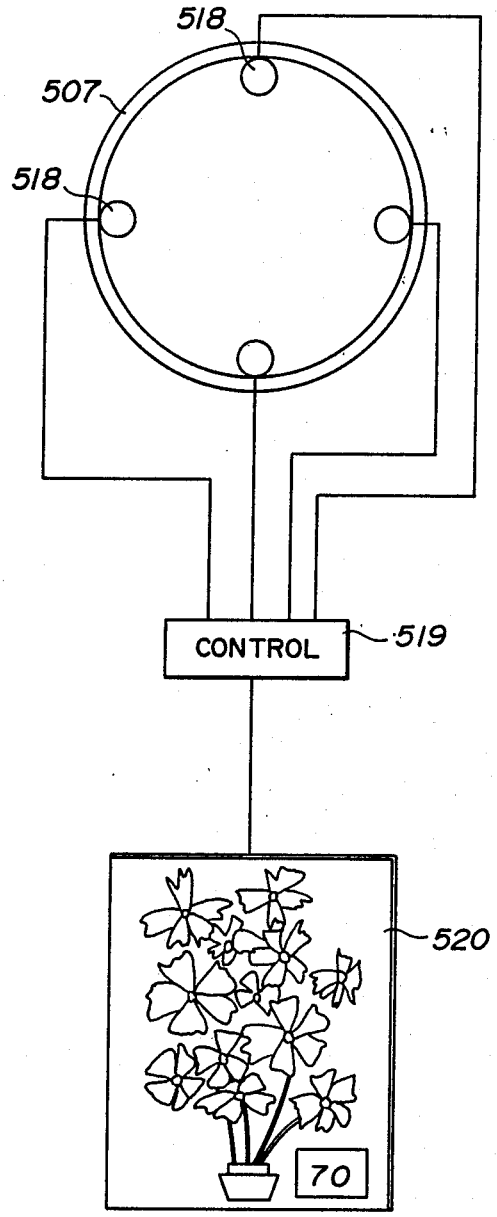
FIG. 28 is an explanatory view showing a musical instrument provided along a handrail in the apparatus for the practice of ambulation in FIG. 1.

FIG. 28 shows an apparatus for the practice of ambulation wherein there are provided musical instruments like drums 518 inside a handrail 507, a control unit 519 receiving beating signals from the drums 518, and a display means 520 for displaying a flower which is colored depending on signals from the control unit 519.

In operation, a patient beats the drums 518 during walking around the handrail 507 so that the beating signals are accumulated in the control unit 519. The monochromatic flower is partly colored on the display means 520 each time when the beating signals is received in the control unit 519 so that a colored proportion of the flower is increased. When the number of beating the separated drums 518 is reached up to a predetermined value, all the flower is colored.

Figure 29:
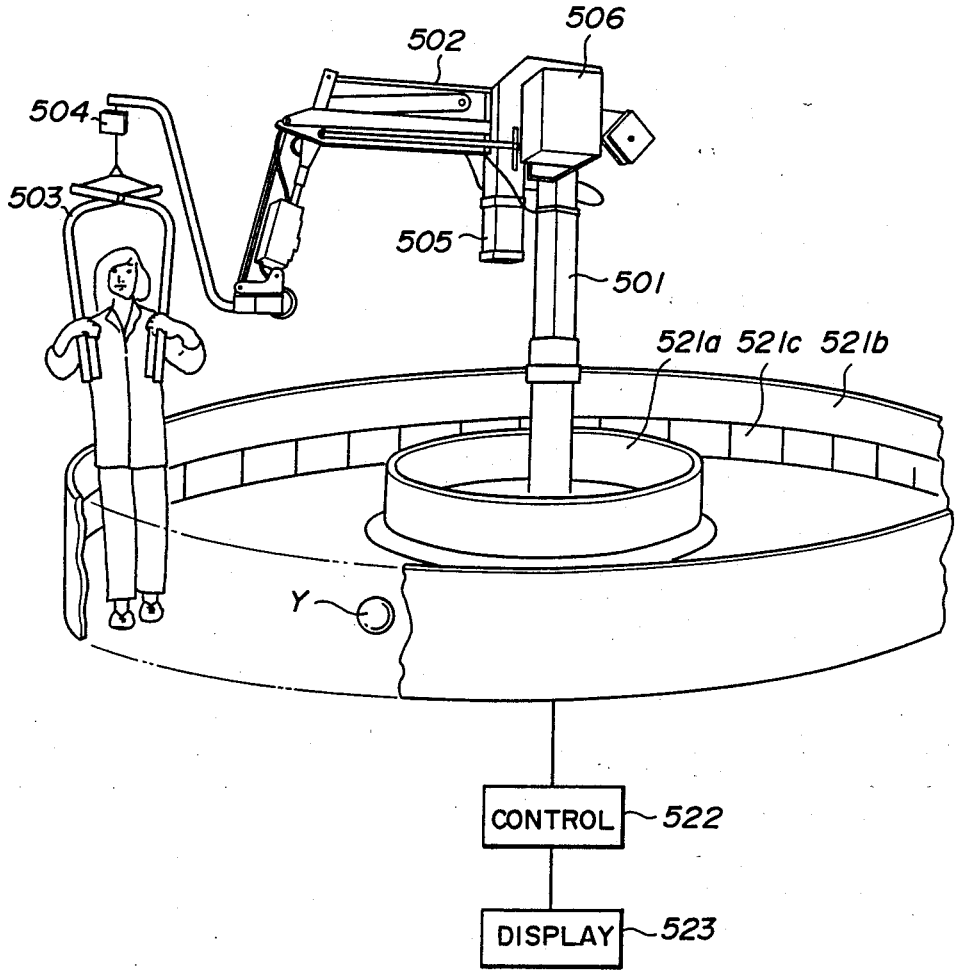
FIG. 29 is a perspective view showing an apparatus for the practice of ambulation in a eighth embodiment according to the invention.

FIG. 29 shows an apparatus for the practice of ambulation which comprises a main body 501, a supporting arm 502, a suspension member 503, a weight sensor 504, a cylinder 505, and a control box 506. Further, there are provided a guard walls 521*a* and 521*b*, a circular array of ball touching sensors 421*c* arranged on the inner surface of the guard wall 521*b*, a control unit 522 for counting the number which the ball touching sensor 521*c* detect a ball Y, and a display means 523 for displaying the number by receiving signals from the control unit 522.

In operation, a patient who is suspended by a suspension means 503 kicks the ball Y during the training of walking so that the ball hits the sensor 521*c*. In this case, the stronger the patient kicks the ball Y, the greater the number is counted by one kick due to the bounce of the ball Y. The sensors 521*c* supplies signals of detecting the ball Y to the control unit 52 in which the signals are counted. The number thus counted is displayed on the display means 523.

Figure 30:
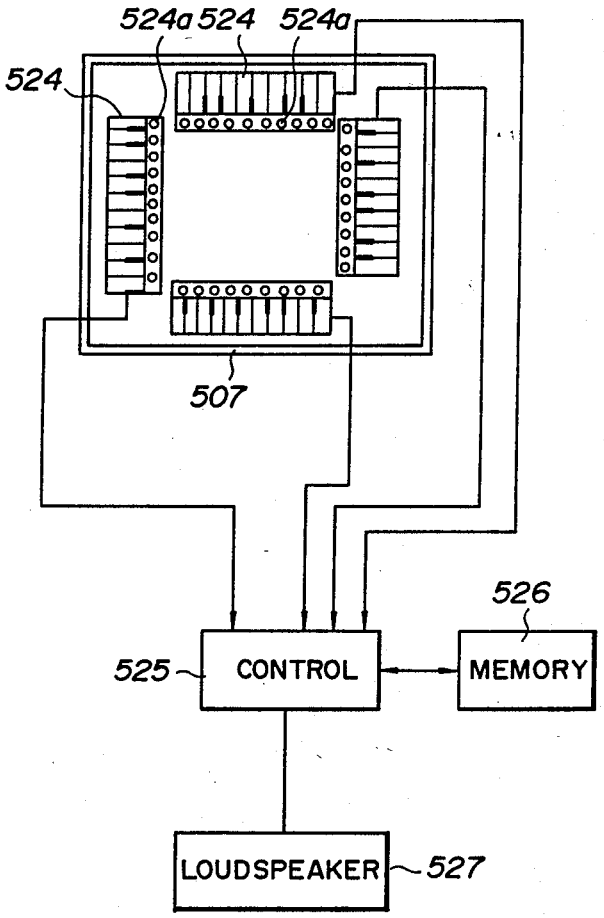
FIG. 30 is an explanatory view showing a musical instrument provided along a walking path in the apparatus for the practice of ambulation in FIG. 1.

FIG. 30 shows an apparatus for the practice of ambulation which comprises keyboards 524 each having lumps 524 equal to the number of keys and arranged inside a handrail 507, and a control unit 525 for receiving key signals from the keyboards 524 to store the key signals in a memory 526 and to control a loudspeaker 527 in accordance with the key signals read from the memory 526.

In operation, four patients who are suspended by respective suspension members touch keyboards 524 simultaneously. The lumps 524*a* corresponding to the touched keys are lit to make it easier to detect which keys are touched, and the key signals are supplied to the control unit 525 to be written into he memory 526. After the patients finish the playing of the keyboards 524, the control unit 525 reads the key signals from the memory 526 thereby to actuate the loudspeaker 527 so that the patients enjoy a concert music flowed from the loudspeaker 527.

Although the invention has been described with respect to specific embodiment for complete and clear disclosure, the appended claims are not to thus limited but are to be construed as embodying all modification and alternative constructions that may occur to one skilled in the art which fairly fall within the basic teaching herein set forth.

What is claimed is:

1. An apparatus for the practice of ambulation, comprising:

means for suspending a patient by a predetermined suspension force;

means for producing said predetermined suspension force;

means for supporting said suspending means and conveying said predetermined suspension force thereto;

means for detecting a weight applied to said suspending means to produce a corresponding weight signal; and means for controlling said suspension force producing means to produce thereby said predetermined suspension force related to said detected weight by receiving said weight signal from said detecting means, wherein said controlling means cooperates with said detecting means to limit an increase of said predetermined suspension force when said detected weight is increased by more than a predetermined rate.

2. An apparatus for the practice of ambulation according to claim 1, wherein:

said means for producing said suspension force comprises an air cylinder having a piston rod connected to said means for supporting said suspending means; and means for regulating an air pressure in said air cylinder in accordance with said detected weight.

3. An apparatus for the practice of ambulation according to claim 2, wherein:

said controlling means operates to limit an increase of said air pressure when said weight is increased by more than a predetermined rate.

4. An apparatus for the practice of ambulation according to claim 2, wherein:

said controlling means operates to limit an increase of said air pressure when a height of said suspending means is changed by more than a predetermined amount.

5. An apparatus for the practice of ambulation according to claim 1 wherein:

said means for producing said suspension force comprises rotating means comprising a motor having a rotor connected to said means for supporting said suspending means to enable rotation thereof; and means for controlling said motor to produce a predetermined torque.

6. An apparatus for the practice of ambulation according to claim 5 wherein:

said controlling means operates to control said rotating means to controllably rotate said supporting means in accordance with a torque of a motor.

7. An apparatus for the practice of ambulation according to claim 6, wherein:

said controlling means operates to control said rotating means to brake a rotation of said rotating means when said weight is increased by more than a predetermined rate.

8. An apparatus for the practice of ambulation according to claim 5, wherein:

said controlling means operates to control said rotating means to rotate said means for supporting said suspension force in accordance with a walking action of said patient suspended by said suspending means.

9. An apparatus for the practice of ambulation according to claim 6, wherein:

said controlling means operates to control said rotating means to brake a rotation of said means for rotating when said suspending is changed by more than a predetermined height.

10. An apparatus for the practice of ambulation according to claim 1, wherein:

said suspending means includes a pair of frame members each having an armpit member supporting the armpits of said patient and a grip portion to be gripped by said patient.

11. An apparatus for the practice of ambulation according to claim 10, further comprising:

means for adjusting a distance between said armpit member and said grip portion.

12. An apparatus for the practice of ambulation according to claim 1, further comprising:

a handrail provided around said rotating means along which said patient walks, wherein said handrail is composed of a predetermined number of unit members.

13. An apparatus for the practice of ambulation, comprising:

means for suspending a patient in accordance with a predetermined suspension force;

means for detecting a weight applied to said suspending means;

means for producing said predetermined suspension force in a manner proportional to said detected weight;

means for supporting said suspending means and conveying said predetermined suspension force thereto;

means for rotating said supporting means;

means for detecting a physical condition of said patient; and means for comparing said detected physical condition with a predetermined physical condition and producing a warning signal when said detected physical condition becomes equal to said predetermined physical condition.

14. An apparatus for the practice of ambulation according to claim 13, wherein:

said physical condition is detected by a blood pressure value and/or a pulse frequency of the patient.

15. An apparatus for the practice of ambulation according to claim 13, further comprising:

means for braking said rotating means when said warning signal is produced.

16. An apparatus for the practice of ambulation according to claim 13, further comprising:

means for writing said physical condition into a personal IC memory card.

17. An apparatus for the practice of ambulation, comprising:

means for suspending a patient in accordance with a predetermined suspension force;

means for detecting a weight applied to said suspending means;

means for producing said predetermined suspension force in a manner proportional to said detected weight;

means for supporting said suspending means and conveying said predetermined suspension force thereto; and means for rotating said supporting means, wherein said means for producing said force comprises an air cylinder, and said supporting means comprises a pantograph means, said pantograph means being of rectangle shape and being adapted to change its shape into a rhombus, and said air cylinder is connected to an apex of said pantograph means at one end and is adapted to slide in a horizontal direction at another end.

18. An apparatus for the practice of ambulation, comprising;

means for suspending a patient in accordance with a predetermined suspension force;

means for detecting a weight applied to said suspending means;

means for producing said predetermined suspension force in a manner proportional to said detected weight;

means for supporting said suspending means and conveying said predetermined suspension force thereto;

means for rotating said supporting means;

means for receiving voice instructions of said patient;

means for detecting a walking pattern of said patient; and means for controlling said force producing means to thereby produce said predetermined force in accordance with said voice instructions, and said rotating means to rotate said suspending means at a predetermined rotation speed in accordance with said voice instructions and said detected walking pattern.

19. An apparatus for the practice of ambulation, comprising:

means for suspending a patient in accordance with a predetermined suspension force;

means for detecting a weight applied to said suspending means;

means for producing said predetermined suspension force in manner proportional to said detected weight and for limiting a change in said suspension force in response to a change in said detected weight;

means for supporting said suspending means and conveying said predetermined suspension force thereto;

means for rotating said supporting means;

means for detecting rotation of said rotating means and producing a signal corresponding thereto; and means for calculating walking data, including at least one of a walking distance and a walking speed, in accordance with said signal.

20. An apparatus for the practice of ambulation according to claim 19, further comprising:

means for recording said walking data into a personal IC memory card.

21. An apparatus for the practice of ambulation comprising:

means for suspending a patient in accordance with a predetermined suspension force;

means for detecting a weight applied to said suspending means;

means for producing said predetermined suspension force in a manner proportional to said weight;

means for supporting said suspending means and conveying said predetermined suspension force thereto;

means for rotating said supporting means;

game instruments arranged along and/or on a walking path of said patient; and means for counting a score of a game played by use of said game instruments and for displaying said score.

* * * * *